US006162508A

United States Patent [19]

Trumble et al.

[11] Patent Number: 6,162,508

[45] Date of Patent: Dec. 19, 2000

[54] MOLYBDENUM PHOSPHATE BASED CORROSION RESISTANT CONVERSION COATINGS

[75] Inventors: William P. Trumble; Patrick T. Lawless, both of Kanata, Canada

[73] Assignee: Nortel Networks Limited, Montreal, Canada

[21] Appl. No.: 09/184,054

[22] Filed: Nov. 2, 1998

[51] Int. Cl.[7] ..... B05D 1/18

[52] U.S. Cl. ..... 427/435; 427/419.8; 427/443.2

[58] Field of Search ..... 427/419.8, 443.1, 427/435, 443.2

[56] References Cited

U.S. PATENT DOCUMENTS

| | | | |
|---|---|---|---|
| 2,839,439 | 6/1958 | Stapleton | 148/6.15 |
| 4,143,205 | 3/1979 | Rowe, Jr. et al. | 428/469 |
| 4,216,032 | 8/1980 | Hyner et al. | 148/6.15 Z |
| 4,233,088 | 11/1980 | Kronstein | 148/6.16 |
| 4,447,273 | 5/1984 | Mueller et al. | 148/6.15 R |
| 5,045,130 | 9/1991 | Gossett et al. | 148/257 |
| 5,135,583 | 8/1992 | Gehmecker et al. | 148/262 |
| 5,607,521 | 3/1997 | Bech-Nielsen et al. | 148/261 |
| 5,683,816 | 11/1997 | Goodreau | 428/461 |
| 5,976,272 | 11/1999 | Seidel et al. | 148/261 |

FOREIGN PATENT DOCUMENTS

| | | |
|---|---|---|
| 1726559 | 4/1992 | U.S.S.R. . |
| 2070073 | 9/1981 | United Kingdom . |

*Primary Examiner*—Shrive Beck
*Assistant Examiner*—Michael Barr
*Attorney, Agent, or Firm*—Angela C. de Wilton

[57] ABSTRACT

Improvements in MolyPhos corrosion resistant coatings for zinc plated surfaces and zinc alloy surfaces are presented, which enhances corrosion protection in marine environments, and other corrosive atmospheres. In particular a cerium fluoride stabilized MolyPhos coating, and organic acid stabilized coatings are provided, which improve resistance to standard salt fog test exposures to at least 300 hrs, thus extending applicability of a conventional MolyPhos coating to applications to telecommunications, electronics, automotive and aviation equipment. MolyPhos coatings offer promise as an environmentally friendly alternative to conventional chromate corrosion coatings.

17 Claims, No Drawings

MOLYBDENUM PHOSPHATE BASED CORROSION RESISTANT CONVERSION COATINGS

FIELD OF THE INVENTION

This invention relates to molybdenum phosphate based ('MolyPhos') corrosion resistant conversion coatings and more particularly for MolyPhos coatings for zinc plated substrate metals.

BACKGROUND OF THE INVENTION

Materials used in the manufacture of electronics enclosures, e.g. frame equipment or other equipment for telecommunications equipment, and steel enclosures for housing printed circuit boards and circuit packs, must be protected against corrosion, particularly for outdoor exposure. Conventionally, the walls of the enclosures have been coated with zinc plating, which in turn has been protected with a chromate conversion coating of varying thickness. The chromate protected zinc coating provides sufficient rust and corrosion protection to the metal of the enclosures for many applications. However, when grounding of such enclosures is required, e.g. to provide Faraday enclosures for electromagnetic shielding of components, it is found that good electrical contacts cannot be made reliably between components having conventional chromate coatings.

Consequently, various approaches have been taken to obtain electrical contact through the coating, i.e. by piercing the coating. For example, special beryllium copper gaskets having sharp spurs may be used to make contact between coated components to providing grounding. However, since the coating is destroyed at the contact points, these areas are left open to corrosion. One solution is to provide some form of local protection, e.g. in the form of tin lead solder at the connection points.

Nevertheless, this structure is not ideal, and electronics enclosures of this type have found to be lacking in meeting current requirements for shielding and improved control electromagnetic interference (EMI). Shielding may be required to protect components in the enclosure from EMI emanating outside the enclosure or for EMI from equipment housed inside the enclosure.

Furthermore, while chromate coatings are satisfactory in providing corrosion resistance that meets industry standard tests, e.g. for exposure to 100 hrs and 300 hrs of salt fog, chromate is known to be toxic to man and the environment, and other less environmentally harmful alternatives are now being sought.

Various conversion coatings have been tested under the auspices of the National Consortium of Manufacturing Sciences and found to be either too complicated, toxic or ineffective. It is also known that various other active metal oxides have been investigated as alternatives to chromate. For example, vanadium, manganese, tungsten oxides have been tested and generally found to be more toxic or polluting than the conventional chromate coatings.

Industry interest in alternative coatings to replace chromate and other existing coatings such as nickel coatings, is increasing in view of environmental initiatives to reduce use of various contaminants, including chromium and nickel, amongst others, such as heavy metals, which are subject to special waste disposal requirements or environmental regulations.

U.S. Pat. No. 5,607,521 entitled 'Method for post-treatment of an article with a metallic surface as well as a treatment solution to be used in the method' to Danish Instituttet for Produckudvikling (IPU), describes a molybdenum phosphate coating with improved corrosion resistance to provide an alternative to conventional chromate coatings. It is believed that such a molybdenum phosphate ('MolyPhos") coating has a lower toxicity than conventional chromate coatings.

Copending U.S. patent application Ser. No. 08/995,410 filed Dec. 19, 1997, now U.S. Pat. No. 5,981,871, entitled 'Electronics enclosures' to the present inventors Trumble et al., which is incorporated herein by reference, describes use of such a MolyPhos conversion coating over a conventional zinc plating, to overcome some of the above mentioned problems in providing electrical connections between coated components of an enclosure, and a method of providing such an enclosure using a MolyPhos coating. Since the MolyPhos coatings also provide good corrosion resistance over zinc, these coatings are desirable alternatives to conventional chromate coatings applications such as electronic enclosures with EMI shielding for telecommunications equipment.

However, while these MolyPhos coatings overcome some disadvantages with chromate coatings, tests results for corrosion resistance of MolyPhos, e.g. the resistance to some industry standard tests such as extended salt fog exposure, suggests that some enhancements or improvements to the existing MolyPhos process are desirable to improve corrosion resistance for more hostile environments, and to meet the more stringent requirements for applications for the automotive and aviation industry.

SUMMARY OF THE INVENTION

The present invention seeks to provide improvements and developments in molybdenum phosphate conversion coatings for zinc plated substrate metals, to overcome or avoid the above mentioned problems. Thus, according to one aspect of the present invention there is provided solution for providing a 'MolyPhos' corrosion resistant coating by electroless plating on a zinc plated substrate comprising: a mixture of a molybdenum salt and phosphoric acid, in a pH adjusted aqueous solution, and a stabilizer.

Beneficially, the stabilizer may be a hydroxy carboxylic acid, for example citric acid. Alternatively the stabilizer comprises an low molecular weight amino acid, e.g. glutamic acid. Alternatively the stabilizer comprises a cerium fluoride salt. Alternatively the stablizer comprises molybdenum nodules.

Addition of such a stabilizer to a conventional molyphos conversion coating solution acts as an electrolytic stablilizer in use of the solution for providing conversion coatings on zinc plated articles. According to another aspect of the invention there is provided a method of providing a conversion coating for a zinc or zinc alloy plated article comprising the steps of: immersing the zinc plated article in a solution comprising: a molybdenum salt, phosphoric acid, in a pH adjusted aqueous solution, and a stabilizer. Preferably, the stabilizer is one of a cerium fluoride salt; an organic acid e.g. a hydroxy carboxylic acid, a low molecular weight amino acid; or molybdenum nodules. Beneficially the mole ratio Mo/P is 0.66, and the pH is maintained in the range about 4.6 to optimize the coating, and the solution is heated to about 60° C. for immersion times of at least 30 seconds. A pH maintained close to range about 4.6 also facilitates disposal of waste solutions without need for additional pH adjustment. The resulting conversion coating on a zinc plated or zinc alloy plated substrate has improved corrosion resistance after 300 hrs salt fog exposure.

These additives to a conventional Molyphos costing process function as electrolytic stabilizers during the coating process. For example, cerium fluoride assists in preventing formation of insoluble carbonates and oxalates. Part of the additive may be incorporated into the conversion coating. For example, in using a cerium fluoride additive, detectable amounts of cerium may be incorporated into the coating.

By virtue of the stabilizers mentioned above, the quality and corrosion resistance of the MolyPhos coating was improved over that produced by existing MolyPhos methods. The conversion coating may comprise cerium fluoride or a hydroxy carboxylic acid, part of the improvement may be due to enhanced uniformity of the coating and improved lifetime of the coating solutions in providing more consistent coatings.

The resulting conversion coating on a zinc plated or zinc alloy plated substrate has improved corrosion resistance after 300 hrs salt fog exposure. According to yet another aspect of the present invention there is provided a molybdenum phosphate conversion coating on a zinc plated substrate having corrosion resistance of 300 hrs salt fog exposure.

The 300 hr salt fog test is a rigorous standard test required by aviation and automotive components, and consequently indicates an excellent degree of corrosion resistance for a wide range of applications.

DETAILED DESCRIPTION OF THE INVENTION

A known process for electroless plating of zinc or magnesium plated metal substrates using a solution comprising molybdenum compound, e.g. molybdic acid and/or a salt of molybdic acid, is described in U.S. Pat. No. 5,607,521 mentioned above, which is incorporated herein by reference. The coating solution is a mixture of sodium molybdate and phosphoric acid. Phosphoric acid may be replaced with other compounds capable of providing a heteropolymolybdate with molybdenum. For example phosphoric acid may be replaced by another acid such as titanic acid, zirconic acid, silicic acid with the addition of mineral acid such as sulphuric acid, or with indium sulphate+sulphuric acid, the sulphuric acid being to maintain an appropriate pH. The pH is adjusted between 1 and 5 and in preferred examples using sodium molybdate and phosphoric acid, the molar ratio of Mo/P is in the range 0.2 to 0.8, certain ratios being optimum, and the pH is maintained strongly acid in a preferred range from about 1.9 to 2.9 for a Mo/P mole ratio of 0.33, or in another preferred pH range from about 3.8 to 4.8 for a mole ratio of Mo/P of 0.66. The latter pH ranges were was observed to provided better corrosion protection.

Thus an electroless plating process is described for coating Zn and Mg alloy plated steel and nickel. Typically, in practice the MolyPhos coating would be applied over zinc plating over steel, e.g. supplied by a third party coating supplier, as would be for coating with a commercial chromate coating which has been in commercial use as a corrosion resistant coating for many years.

In experiments on use of such MolyPhos coatings on zinc plate steel, it was determined that preferably, at least 30 seconds coating time is required to get sufficient layer of coating to meet conventional corrosion tests, including a 100 hr salt fog test. Below 30 seconds immersion time in the coating solution, it was found that the coating thickness was dependent on the immersion time.

Inconsistency of coating may occur if the underlying substrate is held in storage some time before coatings. The process works best when applied to a freshly plated zinc surface to avoid accumulation of oxide or contaminants on the surface.

Another problem encountered in use of existing MolyPhos plating solutions is precipitation of particulates, known as 'sludge out' of the solution, which results in inconsistency in the processing as solution ages. Deposition of particulates tends to lead to nonuniform coating and performance, consistency, reliability problems.

EMBODIMENTS OF THE PRESENT INVENTION

Various stabilizing additives were added to known MolyPhos coating solutions comprising a molybdenum compound, e.g. molybdic acid and a salt of molybdenum, with phosphoric acid in a pH adjusted solution at constant temperature. These solutions were investigated to look for enhanced performance and corrosion resistance, while avoiding environmentally contaminating chemicals where possible.

Specifically, additives were sought to improve the quality of the MolyPhos coating process and thereby increase the corrosion resistance of the coating to pass a 300 hr salt fog test. This test is an industry standard test ASTM B117, required for aviation and automotive industry equipment, and is equivalent to 3 to 5 years seaside environmental exposure.

To avoid sodium residue, it was preferred to use ammonium compounds of molybdenum rather than sodium compounds such as sodium molybdate. Sodium tends to cause corrosion problems, because sodium may form salt deposits with any anions in the solution, which on drying in the coating tend to draw oxygen to the metal. The modifications to a conventional MolyPhos solution tested ranged using deionized and deoxygenated water to adding metal salts, and various acids to complex the components of the solution and thereby adjust and optimize the chemistry of the process.

Significant improvements in corrosion resistance and reliability and consistency of the processing, i.e. avoiding precipitation of particulates was observed with certain organic acid and amino acid additives, and with addition of certain metal salts, e.g. cerium fluoride additives, as will be described in more detail in the examples set out below. Each of these additives acts as an electrolytic stabilizer in the coating solution, to improve the reproducibility and reliability of the process, and thereby improving the quality and corrosion resistance of the resulting coating, as measured by the standard salt fog corrosion tests.

Titanium oxide and cerium oxide additives to the MolyPhos solutions were also tested and the resulting MolyPhos coating did not provide the extended salt fog protection sought.

In these experiments, no significant improvement was observed using deionized and deoxygenated water over a regular water supply.

EXAMPLE 1

Cerium fluoride stabilization of MolyPhos solution. In a conversion coating, similar to that described above, was added 0.05% cerium fluoride. The solution was pH adjusted to 4.6 and the temperature set and maintained at 60° C. When the solution equilibrated, the zinc plated substrate was immersed into the solution for 30 to 45 seconds.

This procedure was designed to enhance the solutions stability of the conversion coating to prevent the formation of particulates that will subsequently deposit on the zinc and which interferes with the uniform deposition of the MolyPhos. Deposition of particulate cause breakdown of the MolyPhos coating with the time temperature and humidity. A further advantage of the addition of cerium fluoride and other fluorides is that it prolongs the life of the conversion coating by reducing the tendency of the Molybdenum to form insoluble products that will cause the solution to "sludge out".

This process reduces required immersion time in the conversion coating solution. Maintaining the pH at 4.6 assures that the ratio of molybdenum to phosphorus is the preferred ratio for corrosion resistance, i.e. at about 0.66 Mo/P mole ratio.

Cerium was preferred over other fluorides tested because cerium fluoride tends to self regulate its solubility in the MolyPhos solution to be optimal for the design intent.

Salt fog corrosion testing to 300 hrs showed no penetration of oxide to the zinc coating.

EXAMPLE 2

Hydroxy Carboxylic Acid Stabilizer.

To the standard MolyPhos solution is added 0.3% of a hydroxy carboxylic Acid such as citric acid or other low molecular weight hydroxy organic acid. This solution is stabilized to a pH of 4.6, and equilibrated to a temperature of 60 degrees centigrade. Zinc plated steel is immersed in this solution from 30 to 45 seconds. This addition of citric acid forms a basic complex where the zinc is chemically etched and the surface is activated to have a higher electro-potential difference between it and the MolyPhos ions. This will form a firmer bond for the conversion coating to the zinc to give more robust environmental protection.

For optimum corrosion resistance, a mole ratio of 0.66 Mo/P is preferred (MolyPhos 66), and the pH is preferably maintained at 4.6. The pH range is preferably in the range from 4.5 to 4.7, but acceptable results are obtained up to pH 4.8; the temperature is preferably held at 56° C. +/−2° C., for an immersion time from 60 to 180 seconds.

The addition of a hydroxy carboxylic acid etches and complexes the surface of the zinc to make a more receptive site for the MolyPhos. The hydroxy carboxylic acid itself is a very good anti-oxidant and metal deactivator which helps stabilize the cured conversion coating.

The hydroxy carboxylic acid additive was also observed to improve the abrasion resistance of the Molyphos coating.

The pH strongly influences the corrosion rate of the resulting coating. The process will work over a range of pH, but optimum corrosion resistance is obtained for Mo/P ratio of 0.66 when the pH is 4.5 to 4.7 and for a Mo/P ratio of 0.33 when the pH is in the range 2.1 to 2.3. As an alternative to citric acid, hydroxy acetic acid acts as a chelating agent that scavenges unwanted ions from the conversion coating solution.

Other suitable hydroxy-carboxylic acids include, for example, tannic acid, lactic acid, and hydroxy acrylic acid.

EXAMPLE 3

Organic Amino Acid Stabilizer

To the standard MolyPhos solution is added 0.03% of an amino acid, for example, glutamic acid. The solution is stabilized to pH of 4.6 and equilibrated of 60 degrees centigrade. Zinc plated steel is immersed in this solution from 30 to 45 seconds. This addition of Glutamic Acid is designed to form a basic complex on the zinc which changes the electro-potential relationship between zinc and the MolyPhos to form a firmer bond of the conversion coating to make it more robust to salt fog another environmental stresses. Maintaining solution of pH 4.6assures that the ratio of molybdenum to phosphorous is at an optimum ratio for corrosion resistance.

The addition of the amino acid complexes the phosphorous acid to make it more reactive to the metal and changes the electro-potential of the zinc plate to form a firmer bond of the MolyPhos coating on the zinc substrate.

For applications described above, e.g electronics enclosures, a coating that provides corrosion protection to the zinc plated steel while maintaining a high degree of electrical conductivity is required. This coating system and others listed in this class are the only ones that will give adequate corrosion protection and electrical conductivity for EMI.

The improved coating process increases the salt fog resistance of the MolyPhos conversion coating without effecting the electrical properties. It also decreases the immersion time of the zinc in the conversion coating solution.

EXAMPLE 4

Molybdenum Metal.

In a solution of Molybdenum Phosphate is added 0.2% of Molybdenum metals in the form of nodules. This solution is pH adjusted to 4.6 and temperature set and maintained at 60 degrees centigrade and the zinc plate is immersed in the solution from 30 to 45 seconds. This addition of Molybdenum metal to the solution is designed to maintain the concentration of Molybdenum at a percentage where the ratio of Molybdenum to Phosphorus is maintained for the best plating resistance.

Maintaining solution of pH 4.6 assures that the ratio of Molybdenum to phosphorous is at the best ratio for corrosion resistance. The addition of the Molybdenum nodules maintains the metal content of the coating solution, i.e. pumps stabilizing metal into the solution as the reaction proceeds and depletes the molybdenum in solution, so that the resulting plating is robust to salt fog another adverse environmental conditions. The treatment described above is well suited for corrosion protection of conventional zinc coatings, such as produced by galvanization of steel, electroplated zinc, hot dip zinc coatings and other known processes. The improved Molyphos process described above may be applied to zinc plated materials, or to those coated with alloys of zinc, e.g. zinc with nickel, cobalt or iron and other materials, which may be treated with a conventional MolyPhos coating.

The resulting MolyPhos coating has excellent conductivity and surface resistivity in the range required to conductive enclosures, e.g. Faraday enclosures for Faraday enclosures for electronics and communications equipment. This is a significant advantage of MolyPhos coatings over other chromate alternatives which have been tested, e.g titanium based coatings, and did not sufficient conductivity.

Thus use of MolyPhos coatings allows for supplementary conductive coatings or conductive gaskets between components to be eliminated.

While conductivity is an advantage, the coating may also be used on materials for other applications, e.g. reinforcing bars (rebars) and other construction applications where conductivity may not be a consideration.

Another advantage of MolyPhos coatings is that the surface adhesion for painting is excellent without need to pre-etching or other extensive pre-treatment of the surface.

In summary, addition of certain stabilizing additives, or electrolytic stabilizers, to a 'standard' MolyPhos coating solution as described above provided improved corrosion resistant and improved reliability and consistency of the coating process.

Beneficially, a mixture of acids i.e. an amino acid and a hydroxy carboxylic acid may provide a synergistic effect.

Thus, although specific embodiments of the invention have been described in detail, it will be apparent to one skilled in the art that variations and modifications to the embodiments may be made within the scope of the following claims.

What is claimed is:

1. A method of providing a conversion coating for a zinc or zinc alloy plated article comprising the steps of:

immersing the zinc plated article in a solution to form a molybdenum phosphate conversion coating, the solution comprising:

a pH adjusted, aqueous solution of a molybdenum salt, phosphoric acid, and an electrolytic stabilizer, comprising a cerium fluoride salt.

2. A method of providing a conversion coating for a zinc or zinc alloy plated article comprising the steps of:

immersing the zinc plated article in a solution to form a molybdenum phosphate conversion coating, the solution comprising:

a pH adjusted, aqueous solution of a molybdenum salt, phosphoric acid, and an electrolytic stabilizer comprising molybdenum nodules.

3. A method of providing a conversion coating for a zinc or zinc alloy plated article comprising the steps of:

immersing the zinc plated article in a solution to form a molybdenum phosphate conversion coating, the solution comprising:

a pH adjusted, aqueous solution of a molybdenum salt, phosphoric acid, and an electrolytic stabilizer comprising a mixture of cerium fluoride and a hydroxyl carboxylic acid.

4. A method according to claim 1 wherein the wherein the mole ratio Mo/P is maintained about 0.66 and the pH is maintained about 4.6.

5. A method according to claim 2 wherein the wherein the mole ratio Mo/P is maintained about 0.66 and the pH is maintained about 4.6.

6. A method according to claim 3 wherein the wherein the mole ratio Mo/P is maintained about 0.66 and the pH is maintained about 4.6.

7. A method of providing a conversion coating for a zinc or zinc alloy plated article, comprising the steps of:

immersing the zinc plated article in a solution to form molybdenum phosphate conversion coating, the solution comprising:

a pH adjusted, aqueous solution of a molybdenum salt, phosphoric acid, and an electrolytic stablilizer, wherein the mole ratio Mo/P is maintained about 0.66 and the pH is maintained about 4.6, and the electrolytic stabilizer is one of:

an amino acid;

a hydroxy-carboxylic acid;

a mixture of an amino acid and a hydroxy-carboxylic acid;

whereby the resulting conversion coating has corrosion resistance to industry standard 300 hr salt fog exposure corrosion resistance testing.

8. A method according to claim 7 wherein the amino acid is glutamic acid.

9. A method according to claim 7 wherein the hydroxy-carboxylic acid is selected from the group consisting citric acid, tannic acid, lactic acid, hydroxy-acetic acid, and hydroxy-acrylic acid.

10. A method according to claim 7 wherein the molybdenum salt is a molybdate.

11. A method according to claim 10 wherein the molybdenum salt comprises ammonium molybdate.

12. A method according to claim 10 wherein the molybdenum compound comprises sodium molybdate.

13. A method according to claim 7 wherein the pH is maintained in the range from 4.5 to 4.8.

14. A method according to claim 7 wherein the solution is heated to about 60° C.

15. A method according to claim 7 wherein the solution is heated to 58° C.

16. A method according to claim 7 wherein the article is immersed for at least 30 seconds.

17. A method according to claim 7 wherein article is immersed for at least 60 to 180 seconds.

* * * * *